United States Patent [19]

Panicci

[11] 4,311,149

[45] Jan. 19, 1982

[54] BEADED TEETHING RING, CLOSURE LATCH

[75] Inventor: Richard L. Panicci, Hanover, Mass.

[73] Assignee: Kiddie Products, Inc., Avon, Mass.

[21] Appl. No.: 110,120

[22] Filed: Jan. 7, 1980

Related U.S. Application Data

[62] Division of Ser. No. 858,537, Dec. 8, 1977, Pat. No. 4,233,714.

[51] Int. Cl.[3] ..... A61J 17/00; A44C 25/00

[52] U.S. Cl. ..... 128/359; D24/45; 63/2; 63/DIG. 3

[58] Field of Search ..... 128/359, 360, 252; 24/201 R; D24/45; D21/107, 108; 403/309, 311, 313, 344; 63/2, DIG. 3

[56] References Cited

U.S. PATENT DOCUMENTS

| | | | |
|---|---|---|---|
| 465,552 | 12/1891 | Barnes | 403/311 |
| 492,047 | 2/1893 | Otis et al. | 403/309 |
| 2,543,933 | 3/1951 | Pommier | 24/230 A |
| 2,714,268 | 8/1955 | Charles | 41/10 |
| 2,893,089 | 7/1959 | Bacon | 24/116 |
| 3,066,501 | 12/1962 | Charles et al. | 63/2 |
| 3,305,254 | 2/1967 | Hopkins | 287/111 |
| 3,974,547 | 8/1976 | Little | 24/201 BN |
| 3,982,779 | 9/1976 | Hickey | 285/328 |
| 4,233,714 | 11/1980 | Panicci | 24/201 R |

FOREIGN PATENT DOCUMENTS

| | | | |
|---|---|---|---|
| 2460505 | 7/1975 | Fed. Rep. of Germany | 24/265 |
| 1287476 | 11/1962 | France | 24/265 |

*Primary Examiner*—Robert W. Michell
*Assistant Examiner*—C. W. Shedd

[57] ABSTRACT

End closure means comprises a latch member having a latch surface, a two part body member defining a latch member receiving recess between the two parts, a hinge connecting the two parts together on one side of the body member, and a pair of mutually engageable headed posts and passages respectively on the two parts and spaced from the latch member recess on the other side of the body member from the hinge. The body member and latch member are at the ends of a self-supporting molded plastic string on which are mounted a plurality of beads.

5 Claims, 6 Drawing Figures

BEADED TEETHING RING, CLOSURE LATCH

This application is a divisional of Ser. No. 858,537 filed on Dec. 8, 1977, now U.S. Pat. No. 4,233,714.

This invention relates to end closures and particularly to end closure means integrally formed on and adapted to join opposite ends of a plastic thread or string, such as in a string of children's teething beads.

Teething beads placed on threads or strings have been known to be ingested by children when the ends of the string become detached. Occasionally, when beads are placed on a highly flexible, e.g., fiber, thread or string, a child will even ingest beads with the string ends still connected. The serious and even catastrophic consequences of such ingestion have indicated the need for an improved end closure to safely secure the string ends and for improved bead strings which will prevent the beads from being placed too deeply within the mouth.

It is, accordingly, a principal object of this invention to provide improved end closure means for safely securing two ends together. It is a further object of this invention to provide end closure means which may be integrally formed with a string of material extending between the ends. It is yet another object to provide end closure means which resemble objects on the string between the ends and which require no separate parts. Yet another object of the invention is to provide end closure means in combination with a string which will reduce or eliminate the likelihood of ingestion of beads on the string.

In general, the invention features closure means comprising a latch member having a latch surface and a body member having two parts defining a latch member receiving recess therebetween adapted to engage the latch surface. The two body member parts, respectively, are provided with facing mutually engageable recesses and protrusions spaced from the latch member recess, the mutually engageable recesses and protrusions having shoulders which resist disengagement after closure to encapsulate the latch member.

In preferred embodiments, the latch member and body member are integrally formed at opposite ends of a thin string of molded, self-supporting, organic, thermoplastic material. The body parts are connected on one side by an integrally formed hinge. The mutually engageable recesses and protrusions are spaced from the latch member recess on the sides opposite the hinge and comprise a pair of posts having enlarged heads thereon and passages of matching configuration, shoulders on the heads and in the passages resisting disengagement after assembly.

The latch member recess and the latch member are offset from the axis within the body between the hinge and the posts, extending to an opening on the axis of the body, the latch surface positioned within the body between the posts. The body member when closed encapsulates the latch member and resembles a bead.

Other objects, features and advantages of this invention will be apparent to those skilled in the art from the following detailed description of a preferred embodiment thereof, taken together with the accompanying drawings, in which.

Figure 1:
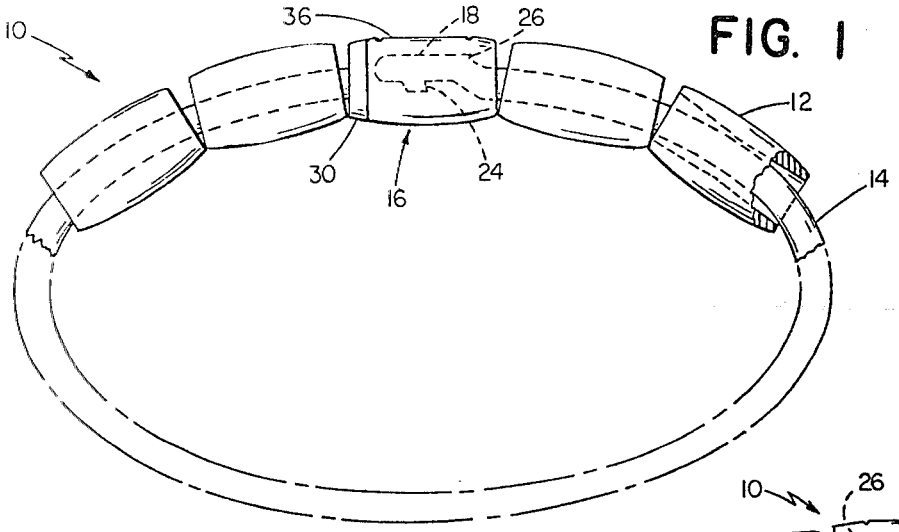
FIG. 1 is a plan view of a string of teething beads including end closure means embodying the invention.
Figure 2:
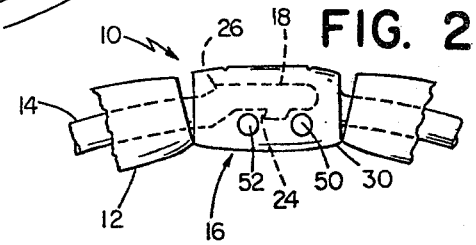
FIG. 2 is a fragmentary view of the reverse side of the beads and end closure means shown in FIG. 1.

A string of teething beads 10 is illustrated in FIGS. 1 and 2. Tubular beads 12 are placed on string 14. End closure means 16 secure the beads on the string. As shown in FIGS. 1 and 2, end closure 16 has an exterior shape resembling one of the beads 12.

Figure 3:
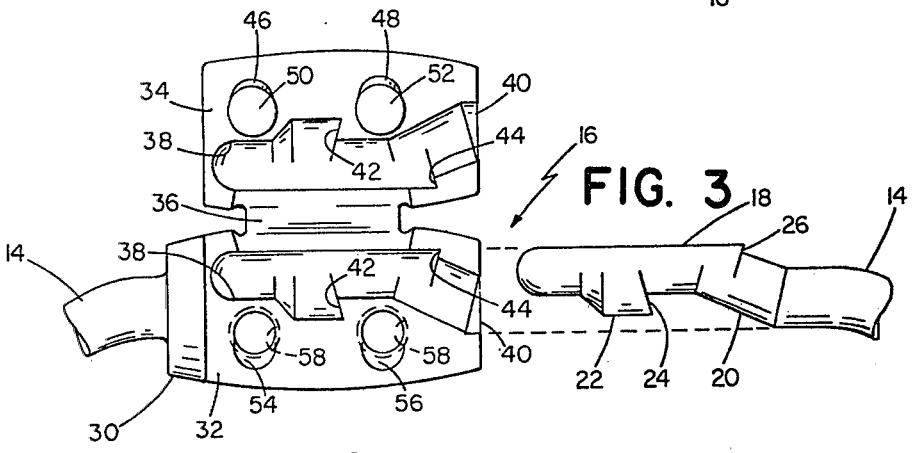
FIG. 3 is an enlarged view of the end closure means of FIG. 1 prior to assembly.
Figure 4:
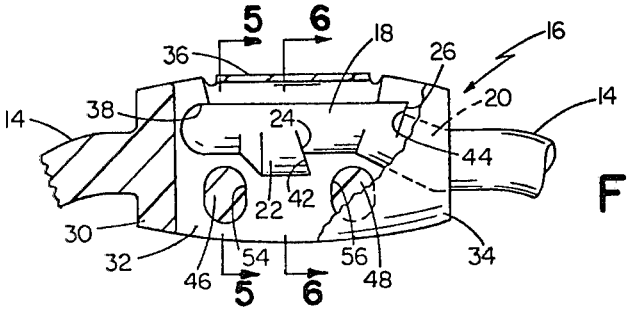
FIG. 4 is a view similar to FIG. 3 of the assembled end closure means partially broken away.

The end closure 16, best shown in FIGS. 3 and 4, comprises a latch member 18 integrally formed at one end of string 14 and a body member 30, externally resembling a bead 12, integrally formed at the other end of string 14.

Figure 6:
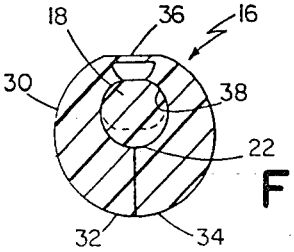
FIG. 6 is a reduced sectional view of the end closure means taken along the line 6—6 of FIG. 4.

Latch member 18 is connected to string 14 by a short section 20 of material extending at an angle from string 14 and the latch member 18, thus offset from string 14, extends on an axis generally parallel to that of body member 30. Midway along the member 18, a radial latch enlargement 22, shown in section in FIG. 6, forms a latching surface, shoulder 24, angled from member 18 rearwardly toward string 14. Another latching surface, shoulder 26 is formed at the junction of member 18 and section 20, also angled rearwardly toward string 14.

Figure 5:
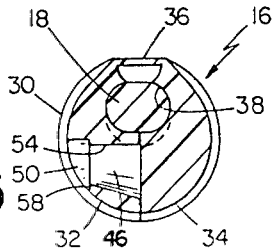
FIG. 5 is a reduced sectional view of the end closure means taken along the line 5—5 of FIG. 4.

Body member 30 comprises two parts 32,34, one part 32 integral with string 14 and the other part 34 connected to the first part 32 by integral hinge 36 on one side of the parts 32,34. A latch member receiving recess 38 is defined within body member 30 between parts 32,34, the recess 38 extending to and defining an opening 40 through which string 14 is connected to latch member 18. Recess 38 has a configuration matching that of the latch member 18 and has shoulders 42,44 adapted to engage shoulders 24,26 of the latch member 18 when assembled. The offset configuration of recess 38 and opening 40 allows string 14 to enter body member 30 on its axis to maintain the appearance of member 30 as a bead on the string while offsetting the latch member and recess to avoid interference with other parts i.e., posts 46,48 and passages 54,56. A pair of posts 46,48 having enlarged heads 50,52 are provided on one body member part 34 and corresponding passages 54,56 having configurations matching posts 46,48, and mutually engageable with posts 46,48, are provided on the other body member part 32, posts 46,48 and passages 54,56 positioned on the sides of recess 38 opposite the hinge 36. Passages 54,56 form shoulders, one 58 shown in FIG. 5, adapted to engage heads 50,52 when assembled. The passages 54,56 are tapered to facilitate placement of the post heads 50,52 therein. Latch enlargement 22 is located between posts 46,48.

String 14 and end closure means 16 are integrally molded from organic thermoplastic material. A material which is self-supporting to retain the molded hoop shape of string 14 is employed, such as high density polyethylene or polypropylene.

The beads 12 ae initially placed on string 14 and latch member 18 is placed in recess 38 of body member 30 with latch surface shoulders 24,26 engaging the shoulders 42,44 of recess 38. The two parts 32,34 of body member 30 are then closed with posts 46,48 entering passages 54, 56. Hinge 36 is sized to hold the body parts 32,34 tightly together when the body parts are closed together. Heads 50,52 are forced through passages 54,56, past shoulders 58 in the passages. Body member 30, thus encapsulates the latch member 18. The heads on posts 50,52 engaging shoulders 58 in passages 54,56 prevent opening of the body member. The latching member 18 is securely held within body member 30 by the engagement of shoulders 24,42 and 26,44. Thus the beads are secured on string 14. The molded, selfsupporting material employed retains the initial hoop shape of the string. Together, the secure fastening of the beads and the hoop shape of the string minimize the likelihood of ingestion of the beads by a child. Advantageously, in appearance, the closure means resembles another bead on the string.

Other embodiments of this invention will be apparent to those skilled in the art which are within the scope of the following claims.

What is claimed is:

1. A string of beads comprising:

a thin hoop-shaped string of molded, self-supporting, organic thermoplastic material;

a plurality of beads on said string;

a latch member having a latching surface forming a latch shoulder, integrally formed on one end of said string;

a body member integrally formed on the other end of said string comprising two parts joined together and encapsulating said latch member therebetween in a recess formed between said parts, said recess having a shoulder engaging said latch shoulder to resist removal of said latch member from said body member;

a hinge integral with and joining said two parts of said body member along one side thereof; and at least one post on one of said body member parts extending into a passage in the other of said body member parts, a head being provided on said post engaging a shoulder formed in said passage to resist disengagement thereof, said post and passage spaced from said recess on the side thereof opposite said hinge.

2. The string of beads claimed in claim 1 in which said string enters said body member on its axis and in which said body member has the exterior configuration of a bead.

3. The string of beads claimed in claim 1 in which a pair of said posts and passages are provided.

4. The string of beads claimed in claim 3 in which said latch member and said recess are offset toward said hinge from the axis of and within said body member.

5. The string of beads claimed in claim 4 in which said string enters said body member on its axis and in which said body member has the exterior configuration of a bead.

* * * * *